US007516702B2

(12) United States Patent
Theurer et al.

(10) Patent No.: US 7,516,702 B2
(45) Date of Patent: Apr. 14, 2009

(54) TRACK RENEWAL MACHINE

(75) Inventors: Josef Theurer, Vienna (AT); Manfred Brunninger, Altenberg (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 12/069,215

(22) Filed: Feb. 8, 2008

(65) Prior Publication Data

US 2008/0163780 A1 Jul. 10, 2008

Related U.S. Application Data

(63) Continuation of application No. PCT/EP2006/063550, filed on Jun. 26, 2006.

(30) Foreign Application Priority Data

Aug. 11, 2005 (AT) ..... A 1346/2005

(51) Int. Cl.

| | |
|---|---|
| ***E01B 29/05*** | (2006.01) |
| ***E01B 29/04*** | (2006.01) |
| ***E01B 29/06*** | (2006.01) |
| ***E02F 5/22*** | (2006.01) |

(52) U.S. Cl. ..... 104/2; 104/7.3; 104/9; 37/104

(58) Field of Classification Search ..... 104/2, 104/5, 6, 7.1, 7.3, 8, 9

See application file for complete search history.

(56) References Cited

U.S. PATENT DOCUMENTS

| | | | | | |
|---|---|---|---|---|---|
| 3,699,894 | A * | 10/1972 | Plasser et al. | ..... | 104/2 |
| 4,152,989 | A * | 5/1979 | Theurer et al. | ..... | 104/2 |
| 4,160,418 | A * | 7/1979 | Theurer | ..... | 104/2 |
| 4,184,431 | A * | 1/1980 | Goel | ..... | 104/2 |
| 4,774,890 | A * | 10/1988 | Theurer | ..... | 104/7.1 |
| 4,854,243 | A * | 8/1989 | Theurer | ..... | 104/7.3 |
| 6,415,720 | B2 * | 7/2002 | Theurer et al. | ..... | 104/7.3 |
| 6,450,101 | B2 * | 9/2002 | Theurer et al. | ..... | 104/2 |

FOREIGN PATENT DOCUMENTS

| | | |
|---|---|---|
| AT | 313341 | 2/1974 |
| AT | 353816 | 3/2007 |
| EP | 0 775780 | 5/1997 |

OTHER PUBLICATIONS

International Search Report.

* cited by examiner

*Primary Examiner*—S. Joseph Morano
*Assistant Examiner*—Jason C Smith
(74) *Attorney, Agent, or Firm*—Collard & Roe, P.C.

(57) ABSTRACT

A track renewal machine is equipped with a ballast conveyor band extending in the longitudinal direction and arranged between upper and lower tie transport units and between ballast receiving means and ballast distributing means. The ballast conveyor band has a discharge end positioned rearwardly of a device for laying new rails, in the operating direction. A device for spacing the new ties from each other is positioned rearwardly of the ballast conveyor band discharge end in the operating direction.

3 Claims, 3 Drawing Sheets

Fig. 4
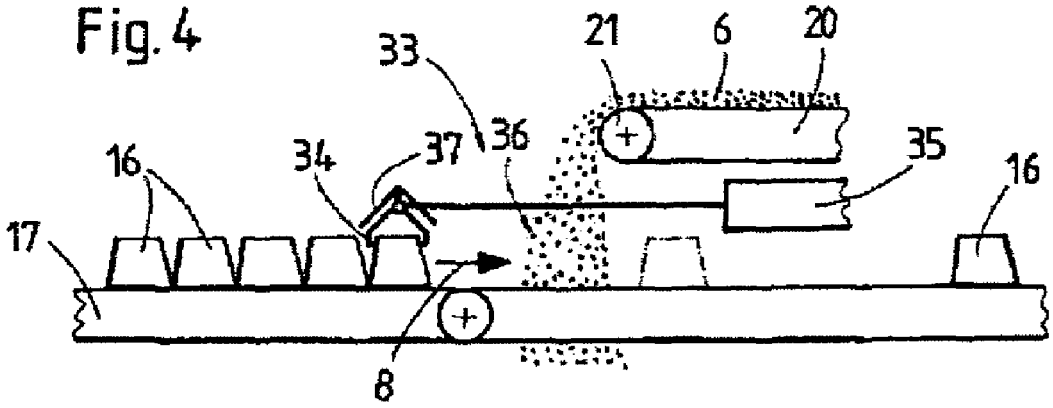
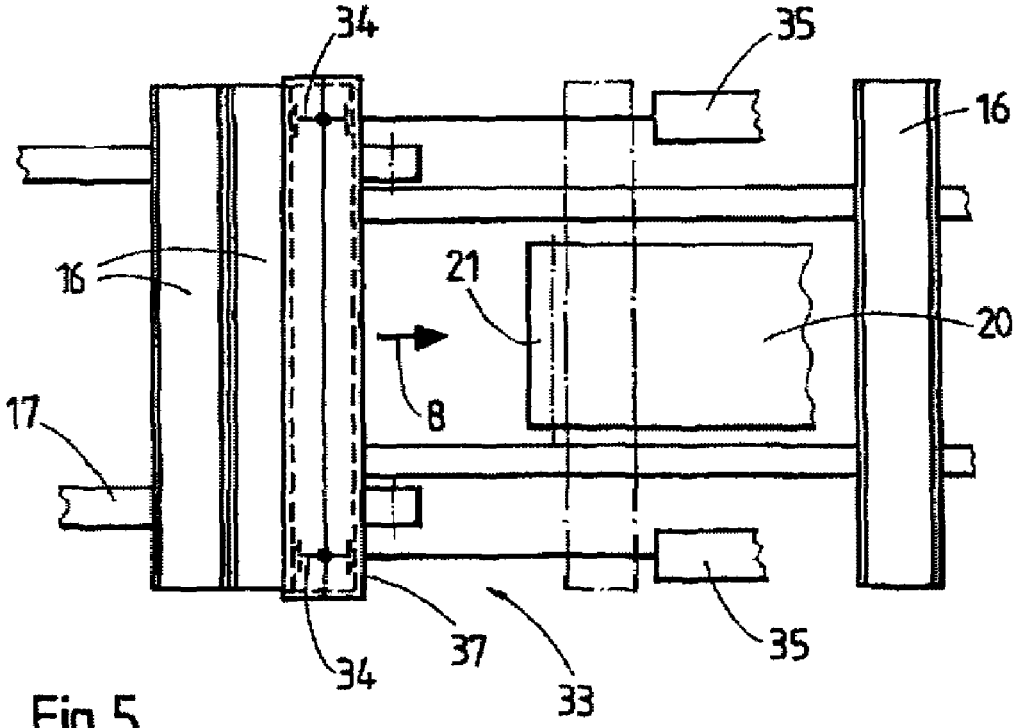
Fig. 5

TRACK RENEWAL MACHINE

CROSS REFERENCE TO RELATED APPLICATIONS

Applicants claim priority under 35 U.S.C. §119 of Austrian Application No. A 1346/2005, filed on Aug. 11, 2005. Applicants also claim priority under 35 U.S.C. §120 of International Application No. PCT/EP2006/063550 filed on Jun. 26, 2006. This application is a by-pass continuation application of said International Application No. PCT/EP2006/063550 filed on Jun. 26, 2006. The International application under PCT Article 21(2) was not published in English. The disclosure of the aforementioned International application and Austrian application are incorporated by reference herein.

BACKGROUND OF THE INVENTION

1. Field of the Invention

The present invention relates to a track renewal machine extending in a longitudinal direction and movable in an operating direction. The machine comprises a lower tie transport unit extending in the longitudinal direction for transporting new ties, means for laying the new ties associated with the lower tie transport unit, an upper tie transport unit positioned above the lower tie transport unit for transporting old ties, means for receiving the old ties associated with the lower tie transport unit, a ballast receiving means positioned between the means for laying the new ties and the means for receiving the old ties, a ballast distributing means arranged rearwardly of the ballast receiving means in the operating direction, and devices for guiding new rails and laying the new rails on the laid new ties.

2. The Prior Art

Machines of this type are known from U.S. Pat. No. 6,415,720 or Austrian patent No. 353,816, the disclosures of which are incorporated herein by reference. Arranging the transport unit for the old ties above the transport unit for the new ties enables the means for receiving the old ties and the means for laying the new ties as well as the ballast receiving means to be concentrated at one end of the machine. This has the advantage that the machine may be operated selectively in opposite operating directions and also that the machine is relatively short. The ballast receiving means enables the ballast in the cribs to be taken up and to be discharged outside the ends of the ties so that it does not interfere with laying the new ties. Afterwards, the ballast is distributed in a subsequent operating step over the entire width of the ballast bed by a ballast plow.

It is also known to convey the received ballast by a conveyor band to the rear end of the machine for discharge on the track, as shown in U.S. Pat. Nos. 4,774,890, 4,854,243 and 6,450,101, as well as EP 0 775,780 or AT 313,341, the disclosure of which are incorporated herein by reference.

SUMMARY OF THE INVENTION

It is the primary object of this invention to improve a track renewal machine of the first-described type by simplifying the return of the ballast which has been removed from the ballast bed during planing, while retaining the advantages of such a track renewal machine.

The above and other objects are accomplished according to the invention by equipping such a machine with a ballast conveyor band extending in the longitudinal direction and arranged between the upper and lower tie transport units and between the ballast receiving means and the ballast distributing means, the ballast conveyor band having a discharge end positioned rearwardly of the device for laying the new rails in the operating direction, and a device for spacing the new ties from each other positioned rearwardly of the ballast conveyor band discharge end in the operating direction.

The positioning of the ballast conveyor band between the upper and lower tie transport units does away with the intermediate deposition of the ballast on the track, as has been necessary with known track renewal machines of this type. Rather, the machine of the present invention enables the ballast to be discharged and distributed over the entire width of the track without interfering with the tie transport and without having to be deposited on the track in an intermediate step. The ballast falls without problems into the cribs between the new ties of the renewed track. This is accomplished without in any way diminishing the advantages of this track renewal machine type while the extra construction costs are relatively low.

BRIEF DESCRIPTION OF THE DRAWING

The above and other objects, advantages and features of this invention will become more apparent from the following detailed description of a now preferred embodiment thereof, taken in conjunction with the accompanying drawing wherein

FIGS. 4 and 5 are enlarged simplified side and top views, respectively, of a device for displacing a new tie in the longitudinal direction.

DETAILED DESCRIPTION OF THE PREFERRED EMBODIMENT

Figure 1:
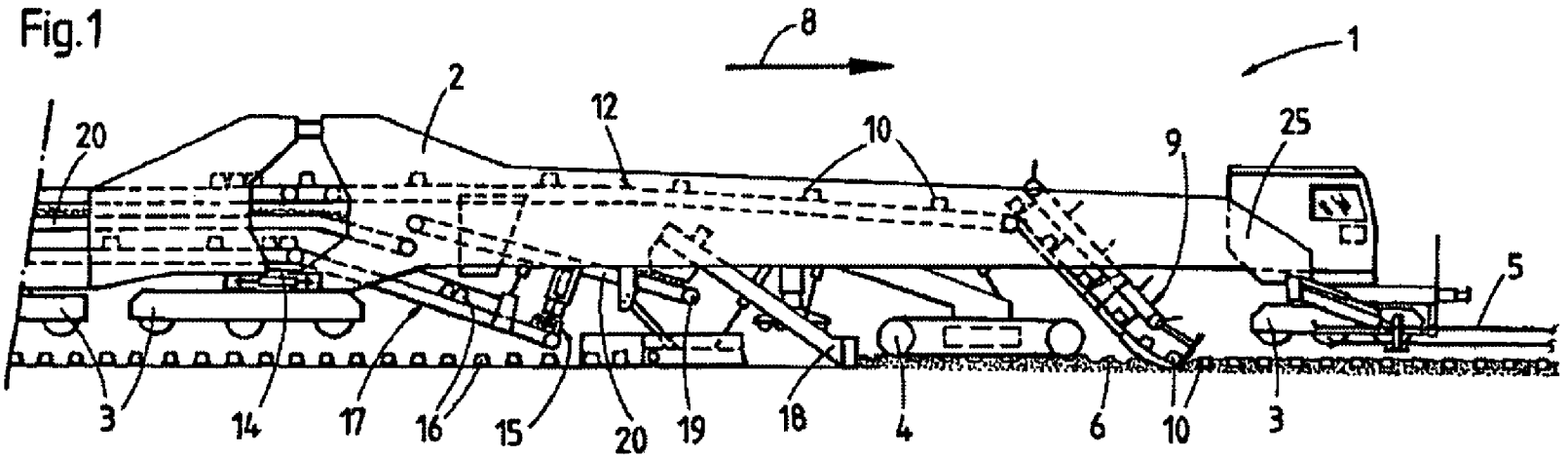
FIGS. 1 and 2 are schematic side elevational views of the front and rear part, respectively, of a track renewal machine according to the invention.
Figure 2:
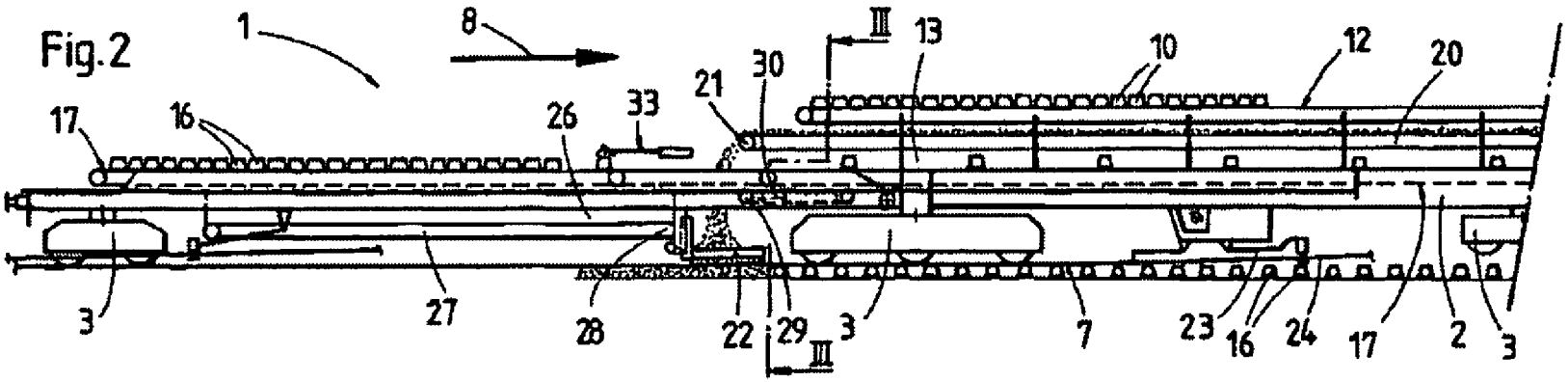

Referring first to FIGS. 1 and 2, there is shown track renewal machine 1 having machine frame 2 extending in a longitudinal direction and movable in an operating direction indicated by arrow 8. Undercarriages 3, 3 support the machine frame on rails 5 and crawler vehicle 4 supports the machine frame on ballast 6 of track 7. Means 9 for receiving and picking up old ties 10 is mounted on the machine frame at its front end 25, as seen in the operating direction, and is associated with upper tie transport unit 12. This is positioned above lower tie transport unit 17 extending in the longitudinal direction for transporting new ties 16. Upper tie transport unit 12 extends in the longitudinal direction and is designed to transport the old ties to rear machine frame section 13 of the machine, as seen in the operating direction. The rear and front machine frame sections are linked by swivel joint 14 to enable the two sections of the long machine to pivot in a track curve. Undercarriages 3, 3 may be lifted, as shown in FIG. 1, when crawler vehicle 4 supports the machine on the ballast bed. The lower tie transport unit is arranged immediately adjacent swivel joint 14 on the front machine frame section. Means 15 for laying new ties 16 is associated with lower tie transport unit 17.

Ballast receiving means 18 is positioned between means 15 for laying new ties 16 and means 9 for receiving old ties 10, and ballast distributing means 22 is arranged rearwardly of the ballast receiving means and device 23 for guiding and laying new rails 24 on the laid new ties.

According to the present invention, a ballast conveyor band 20, which extends in the longitudinal direction, is arranged between the upper and lower tie transport units 12, 17 and between the ballast receiving means 18 and the ballast distributing means 22. The ballast conveyor band has inlet end 19 positioned to receive ballast from ballast receiving means 18 and discharge end 21 rearwardly of the device 23 for laying new rails 24 on laid new ties 16, in the operating direction.

Device 33 for spacing the new ties from each other is positioned rearwardly of ballast conveyor band discharge end 21, in the operating direction. As shown in FIGS. 4 and 5, device 33 comprises a pair of grippers 34 for gripping the ends of the new tie 16 which leads a group of abutting new ties, in the operating direction, and drive 35, which is attached to the grippers, designed to move the gripped new tie forward, in the operating direction, to place it underneath ballast discharge end 21. To prevent the discharged ballast 36 from being deposited on new tie 16, cover 37 is connected to grippers 34 to extend over the new tie.

Figure 3:
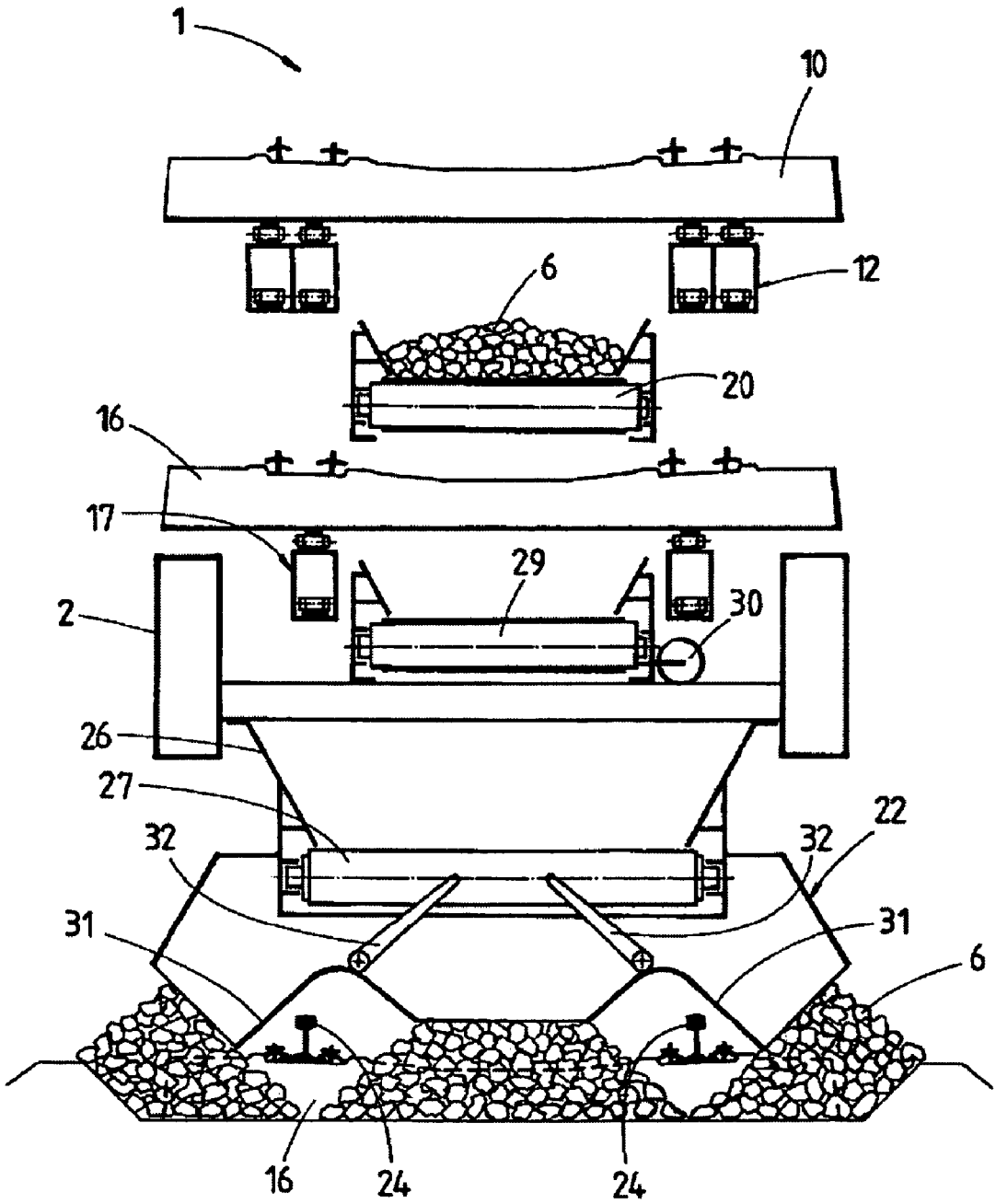
FIG. 3 is an enlarged simplified cross section along line III-III of FIG. 2.

As best shown in FIG. 3, ballast storage device 26 is arranged rearwardly of ballast conveyor band 20, in the operating direction. The ballast storage device has conveyor band 27 forming a bottom of the ballast storage device. As shown in FIG. 2, conveyor band 27 has ballast discharge end 28 positioned above ballast distributing means 22 for discharging ballast 6 on track 7.

A third conveyor band 29 is positioned below ballast conveyor band discharge end 21 and between ballast conveyor band 20 and ballast storage device conveyor band 27. The third conveyor band is displaceable in the longitudinal direction, and drive 30 is designed to displace third conveyor band 29 for selectively conveying ballast 6 from the ballast conveyor band to the storage device conveyor band.

As shown in FIG. 3, ballast distributing means 22 is equipped with a pair of tunnels 31 covering new rails 24, as well as pivotal baffles 32. Other embodiments of ballast distributing means are known, and this is not part of the invention.

Machine 1 is operated in the following manner:

At the beginning of a track renewal operation, ballast 6 excavated by ballast receiving means 18 is conveyed by ballast conveyor band 20 to ballast distributing means 22 whence it is discharged into ballast storage device 26 by means of retracted third conveyor band 29. As shown in the drawing, ballast conveyor band 20 may be comprised of two or more sections.

As soon as machine 1 has advanced in operating direction 8 a distance corresponding to the distance between ballast receiving means 18 and ballast distributing means 22, third conveyor band 29 is displaced back into the inoperative forward position, as shown in FIG. 2. As a result, ballast 6 falls from discharge end 21 onto ballast distributing means 22 through lower tie transport unit 17. In this way, ballast is returned to renewed track 7 immediately behind undercarriage 3 running on the new rails. The ballast stored in ballast storage device 26 is used for supplying the last track section at the end of the track renewal operation.

What is claimed is:

1. A track renewal machine extending in a longitudinal direction and movable in an operating direction, which comprises (a) a lower tie transport unit extending in the longitudinal direction for transporting new ties, (b) means for laying the new ties associated with the lower tie transport unit, (c) an upper tie transport unit positioned above the lower tie transport unit for transporting old ties, (d) means for receiving the old ties associated with the upper tie transport unit, (e) a ballast receiving means positioned between the means for laying the new ties and the means for receiving the old ties, (f) a ballast distributing means arranged rearwardly of the ballast receiving means in the operating direction, (g) devices for guiding new rails and laying the new rails on the laid new ties, (h) a ballast conveyor band extending in the longitudinal direction and arranged between the upper and lower tie transport units and between the ballast receiving means and the ballast distributing means, the ballast conveyor band having a discharge end positioned rearwardly of the device for laying the new rails in the operating direction, and (i) a device for spacing the new ties from each other positioned rearwardly of the ballast conveyor band discharge end in the operating direction.

2. The track renewal machine of claim 1, further comprising a ballast storage device arranged rearwardly of the ballast conveyor band in the operating direction, the ballast storage device having a conveyor band forming a bottom of the ballast storage device, the conveyor band forming the bottom having a ballast discharge end positioned above the ballast distributing means for discharging ballast on the track.

3. The track renewal machine of claim 2, further comprising a third conveyor band positioned below the ballast conveyor band discharge end and between the ballast conveyor band and the ballast storage device conveyor band, the third conveyor band being displaceable in the longitudinal direction, and a drive for displacing the third conveyor band for selectively conveying ballast from the ballast conveyor band to the storage device conveyor band.

* * * * *